US008177442B2

(12) United States Patent
Abbott et al.

(10) Patent No.: US 8,177,442 B2
(45) Date of Patent: May 15, 2012

(54) DIGITAL PRINTING MACHINE AND PLATEN ASSEMBLY FOR PRINTING ON MULTIPLE GARMENT PORTIONS

(75) Inventors: Michael D. Abbott, Statesville, NC (US); Dean Craver, King, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 426 days.

(21) Appl. No.: 12/469,853

(22) Filed: May 21, 2009

(65) Prior Publication Data

US 2010/0294152 A1 Nov. 25, 2010

(51) Int. Cl.
*B41J 3/28* (2006.01)

(52) U.S. Cl. ..... 400/48

(58) Field of Classification Search ..... 400/48, 400/82, 23, 44; 101/407.1; 347/1
See application file for complete search history.

(56) References Cited

U.S. PATENT DOCUMENTS

| | | | | |
|---|---|---|---|---|
| 4,841,306 | A | 6/1989 | Archer et al. | |
| 4,846,058 | A | 7/1989 | Farris | |
| 5,199,353 | A | 4/1993 | Szyszko | |
| 5,467,973 | A | 11/1995 | Grausher et al. | |
| 5,673,621 | A | 10/1997 | Vaughan | |
| 6,059,391 | A | 5/2000 | Fulkerson et al. | |
| 6,095,628 | A * | 8/2000 | Rhome | 347/4 |
| 6,640,714 | B1 | 11/2003 | Papa | |
| 6,755,494 | B2 | 6/2004 | Park | |
| 6,908,190 | B2 | 6/2005 | Iwatsuki | |
| 7,040,748 | B2 | 5/2006 | Niimi et al. | |
| 7,413,301 | B2 | 8/2008 | Niimi et al. | |
| 7,954,921 | B2 * | 6/2011 | Ben-Zur et al. | 347/21 |
| 2004/0179081 | A1 | 9/2004 | Nimi et al. | |
| 2005/0179708 | A1 | 8/2005 | Ben-Zur | |
| 2006/0203069 | A1 | 9/2006 | Niimi et al. | |
| 2006/0249039 | A1 | 11/2006 | Feldman et al. | |
| 2007/0068403 | A1 | 3/2007 | Fresener et al. | |
| 2007/0103529 | A1 | 5/2007 | Pearl et al. | |
| 2009/0090257 | A1 | 4/2009 | Feldman et al. | |

FOREIGN PATENT DOCUMENTS

EP 2033795 A1 3/2009

OTHER PUBLICATIONS

Kornit Digital, Ltd., Kornit 93X, Direct-On-Garment Digital Printing User's Guide, Version 1.0, Jan. 2006.
Borucki, Paul J., Direct Digital Printing for Garments, SGIA Journal, Third Quarter 2005, pp. 15-17.

* cited by examiner

*Primary Examiner* — Seung Lee
(74) *Attorney, Agent, or Firm* — Womble Carlyle Sandridge & Rice, LLP

(57) ABSTRACT

A digital printing machine and a platen assembly therefore for printing on multiple garment portions, the platen assembly comprising a base member configured for operation with a printing machine, and multiple garment support members that are attached to the base member. Each support member comprises a first portion attached to the base member and a second substantially horizontal portion extending outwardly from the base member. The garment support members are configured to support multiple garment portions, permitting printing on the multiple garment portions in a single printing operation.

12 Claims, 6 Drawing Sheets

DIGITAL PRINTING MACHINE AND PLATEN ASSEMBLY FOR PRINTING ON MULTIPLE GARMENT PORTIONS

BACKGROUND

Digital printing machines may include platens, or pallets, on which items to be printed, such as garments, are positioned for printing.

The conventional platens used in known digital printing machines are formed as substantially flat beds, i.e., having a substantially horizontal upper surface area. Conventional platens for garments are sized and shaped to hold a single garment and to present a single surface of the garment (such as a shirt front, a shirt back, or a shirt sleeve) to the printing head(s) of the printing machine. Thus, conventional platens only allow printing on a single surface of a single garment during a given printing operation.

The limitation of printing on a single surface of a single garment results in printing inefficiencies. In order to print on multiple garments, each garment must be positioned on a platen and printed one at a time. In order to print on multiple surfaces of a single garment, the garment must undergo multiple printing operations, and must be repositioned on a platen or placed on a different platen for each printing operation. These constraints can result in excessively long printing times and require a greater amount of manual labor than desired.

In view of the above, it is desirable to provide a digital printing machine having a platen assembly that enables printing on multiple garment portions or surfaces in a single printing operation.

SUMMARY

A digital printing machine and a platen assembly for a digital printing machine are disclosed. According to one embodiment, a platen assembly comprises multiple support members configured to support multiple garment portions so as to permit printing on multiple portions of the same garment in a single printing operation. In another embodiment, a platen assembly comprises multiple support members configured to support multiple garments so as to permit printing on the same portion or portions of multiple garments in a single printing operation. In yet another third embodiment, a digital printing machine includes a platen assembly configured to permit printing on multiple garment portions in a single printing operation. By "single printing operation," we mean that the digital printing machine is programmed, and the platen assembly configured, to print on multiple garment portions without having to stop the digital printing machine to remove, reposition, or replace the garment portions.

Further features and advantages of the invention will be apparent upon reference to the following description, appended drawings and claims.

DETAILED DESCRIPTION

Figure 1:
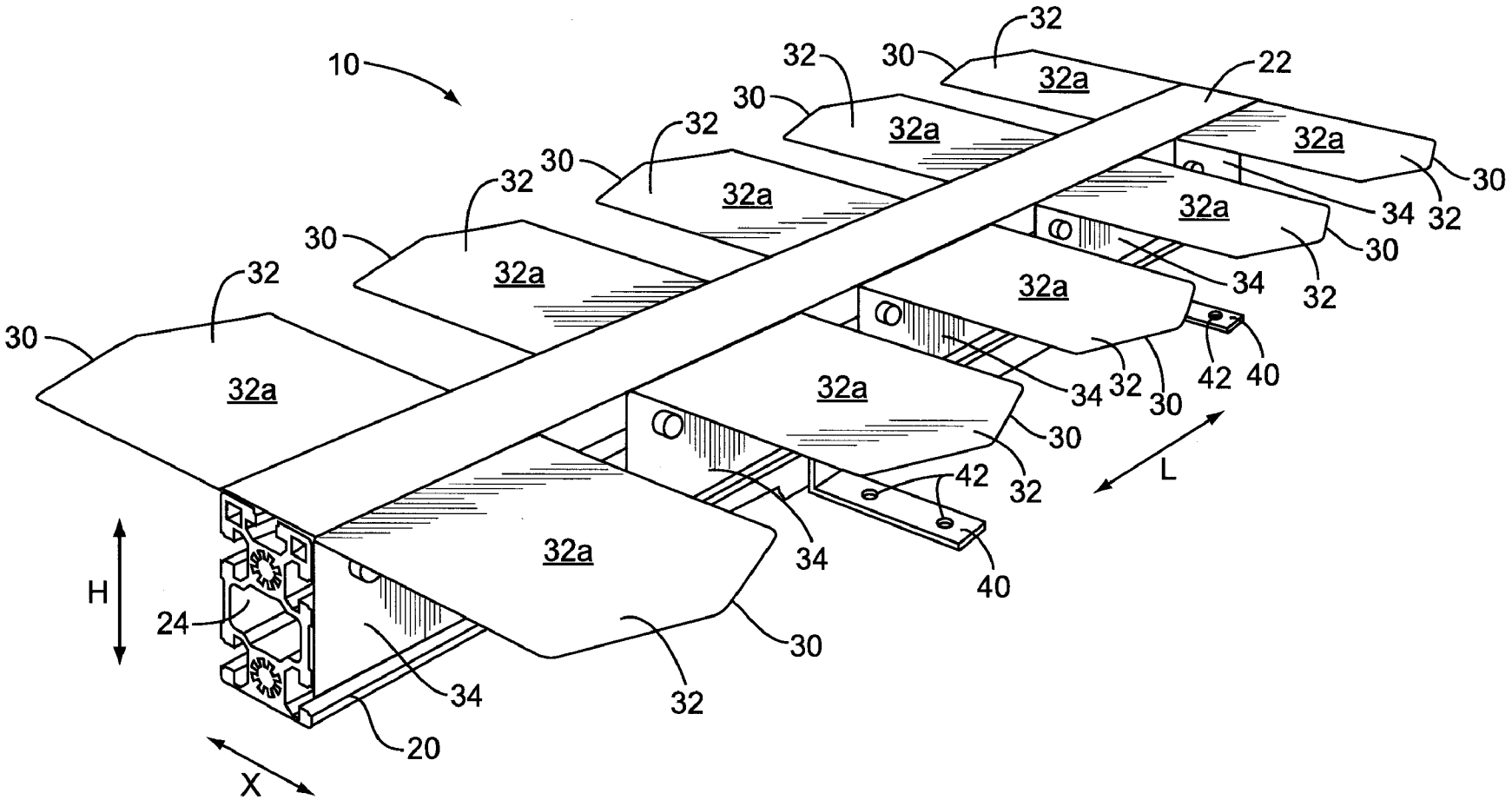
FIG. 1 is a perspective view of a platen assembly for a digital printing machine, according to one embodiment of the invention.

FIGS. 1-5 show a platen assembly 10 for a digital printing machine (not shown), according to one embodiment of the invention. The platen assembly 10 includes an elongate base member 20 and a plurality of garment support members 30 attached to opposite, longitudinally extending sides 24 of the base member 20. Each of the garment support members 30 includes a first, vertically extending portion 34 attached to a side 24 of the base member 20, and a second portion 32 extending laterally (in direction X) outwardly from the sides 24 and providing a substantially horizontal support surface about which a garment (not shown) may be positioned. The platen assembly 10 may further include a plurality of support legs 40 attached to the base member 20 for supporting the platen assembly 10 on a table or conveyor (not shown) of a digital printing machine. The support legs 40 may include fastening openings 42 which allow the legs 40 to be fastened to the printing table or conveyor (not shown) of the printing machine. The platen assembly 10 should be constructed of a material that is sufficiently strong and rigid to support garments during printing. Examples of suitable materials include steel, metals, and metal alloys; however other suitable materials may be used.

Figure 2:
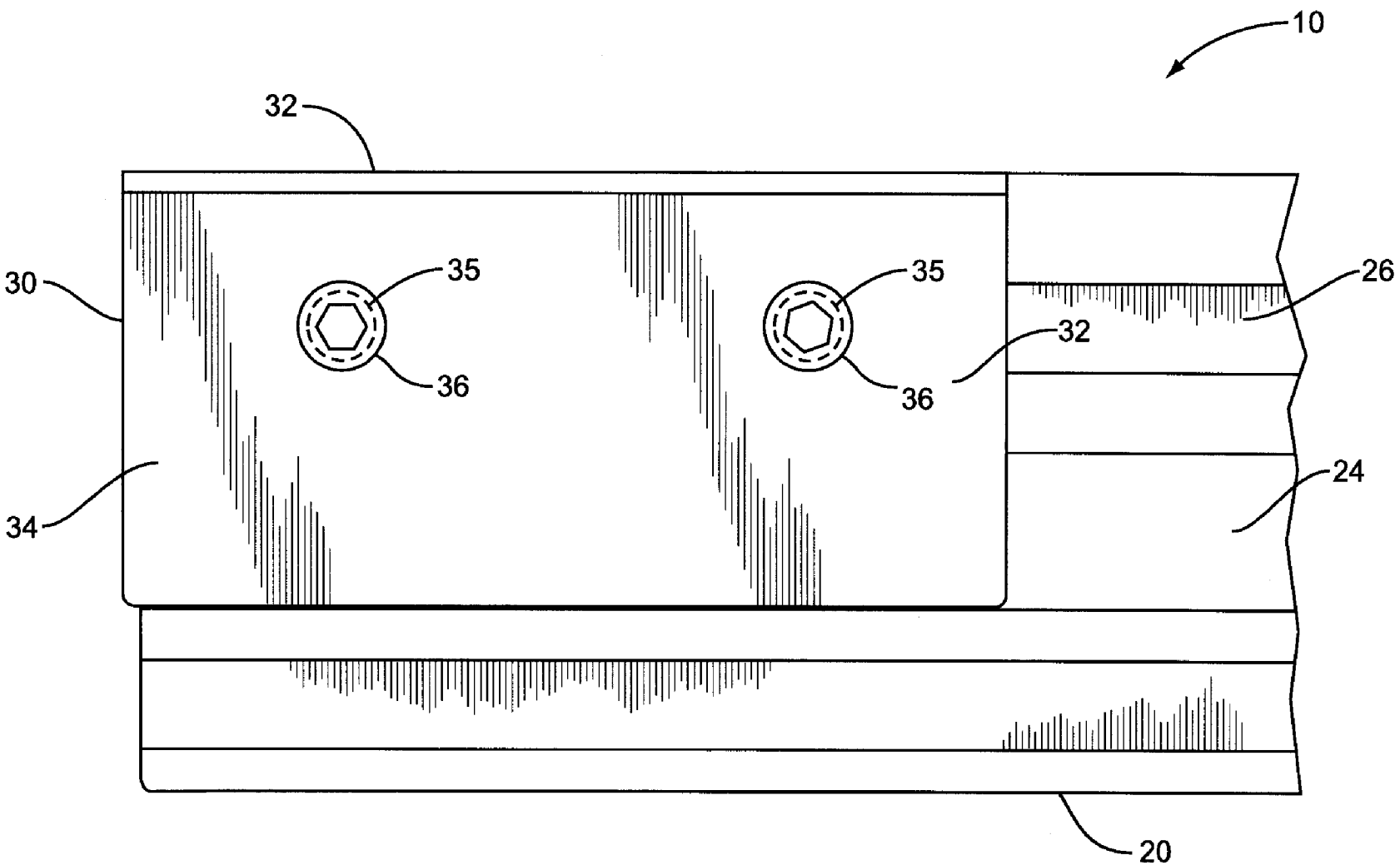
FIG. 2 is a close-up side view showing a garment support member of the platen assembly of FIG. 1.
Figure 4:
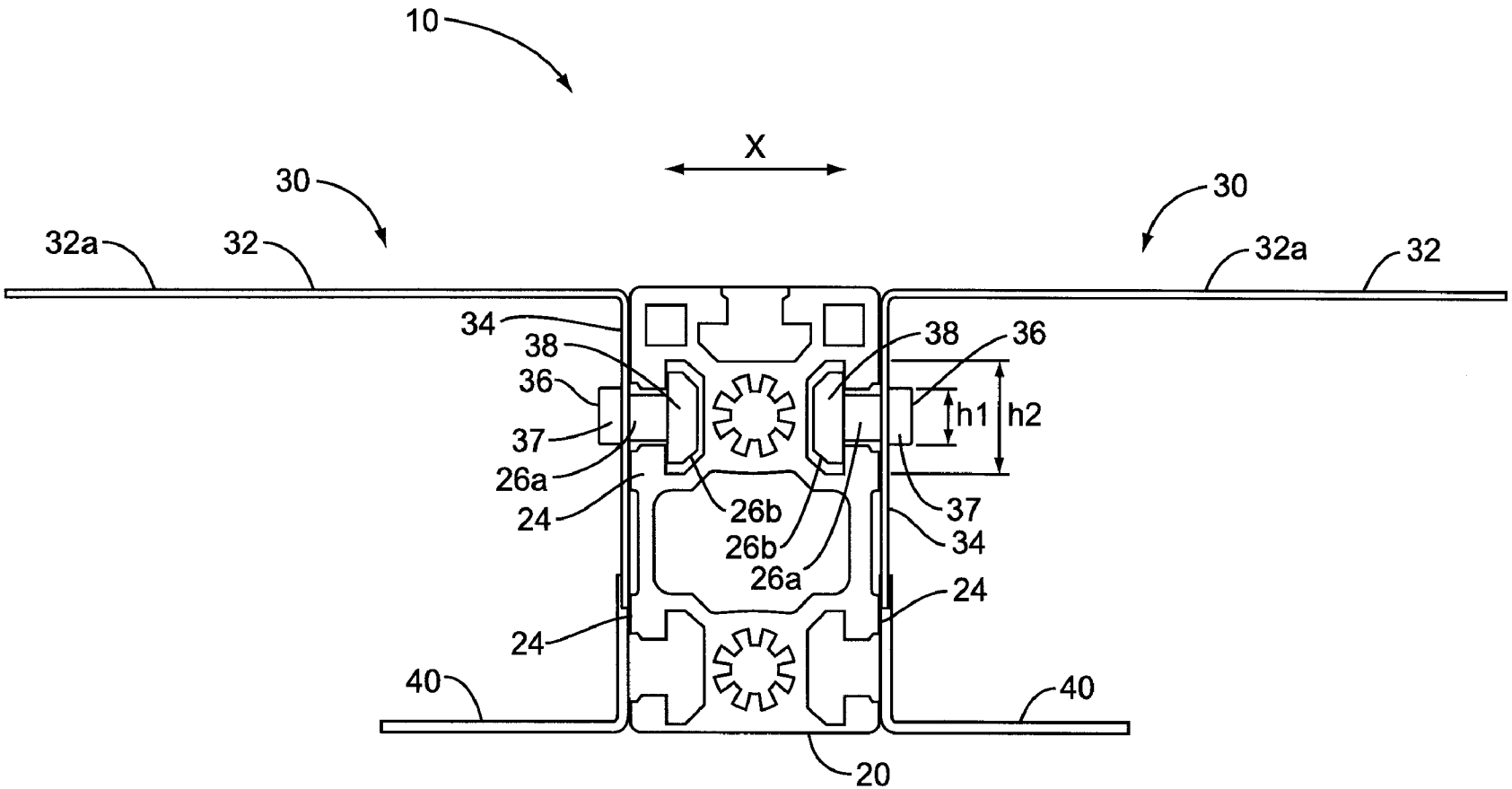
FIG. 4 is an end view of the platen assembly of FIG. 1 [not an end view if the support legs 40 are shown in perspective].
Figure 5:
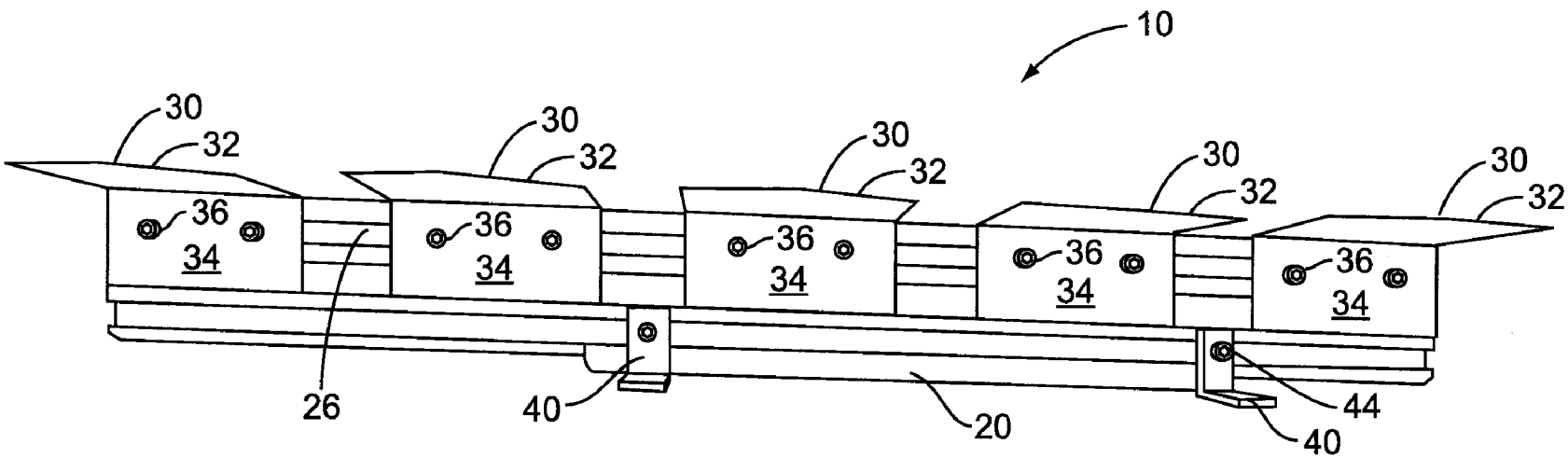
FIG. 5 is a side view of the platen assembly of FIG. 1.

As best shown in FIGS. 2 and 5, the sides 24 each include a longitudinally extending recessed open channel 26 that extends along the entire length (in direction L) of the base member 20 for receiving and retaining female fastening members 38 (FIG. 4) that help secure the garment support members 30 to the base member 20, as described in greater detail below.

As best shown in FIGS. 2 and 4, the first portion 34 of each support member 30 may be adjustably attached to the base member 20 by fasteners 36. Referring to FIGS. 4 and 5, the fasteners 36 for each support member 30 include a pair of threaded male fastening members, such as bolts 37, and a pair of corresponding female fastening members 38. Each of the pair of female fastening members 38 is configured to receive and engage the threaded male fastening member 37. It should be understood that the number of male fastening members 37 and corresponding threaded openings 39 may vary, as desired.

An exemplary manner in which a garment support member 30 may be attached to the base 20 is best illustrated in FIG. 4. As shown in FIG. 4, the channel 26 includes an exterior channel portion 26*a* having a height h1 and an adjacent interconnected interior channel portion 26*b* having a height h2 that is greater than the height h1. The female fastening member 38 is slidably received in the interior channel portion 26*b* and has a height that is greater than the height h1 of the exterior channel portion 26*a*. Thus, the female fastening member 38 is retained within the interior channel portion 26*b* due to the reduced height h1 of the exterior channel portion 26*a*. Male fastening members 37 are inserted through respective openings 35 (FIG. 2) in the first portion 34 of each respective garment support member 30, through the exterior channel portion 26*a*, and into the respective threaded openings (not shown) in the female fastening members 38. The garment support member 30 may be secured in a fixed location along the base member 20 by tightening the engagement between the male fastening members 37 and the female fastening members 38 until the garment support member is securely held against the side 24.

Figure 3:
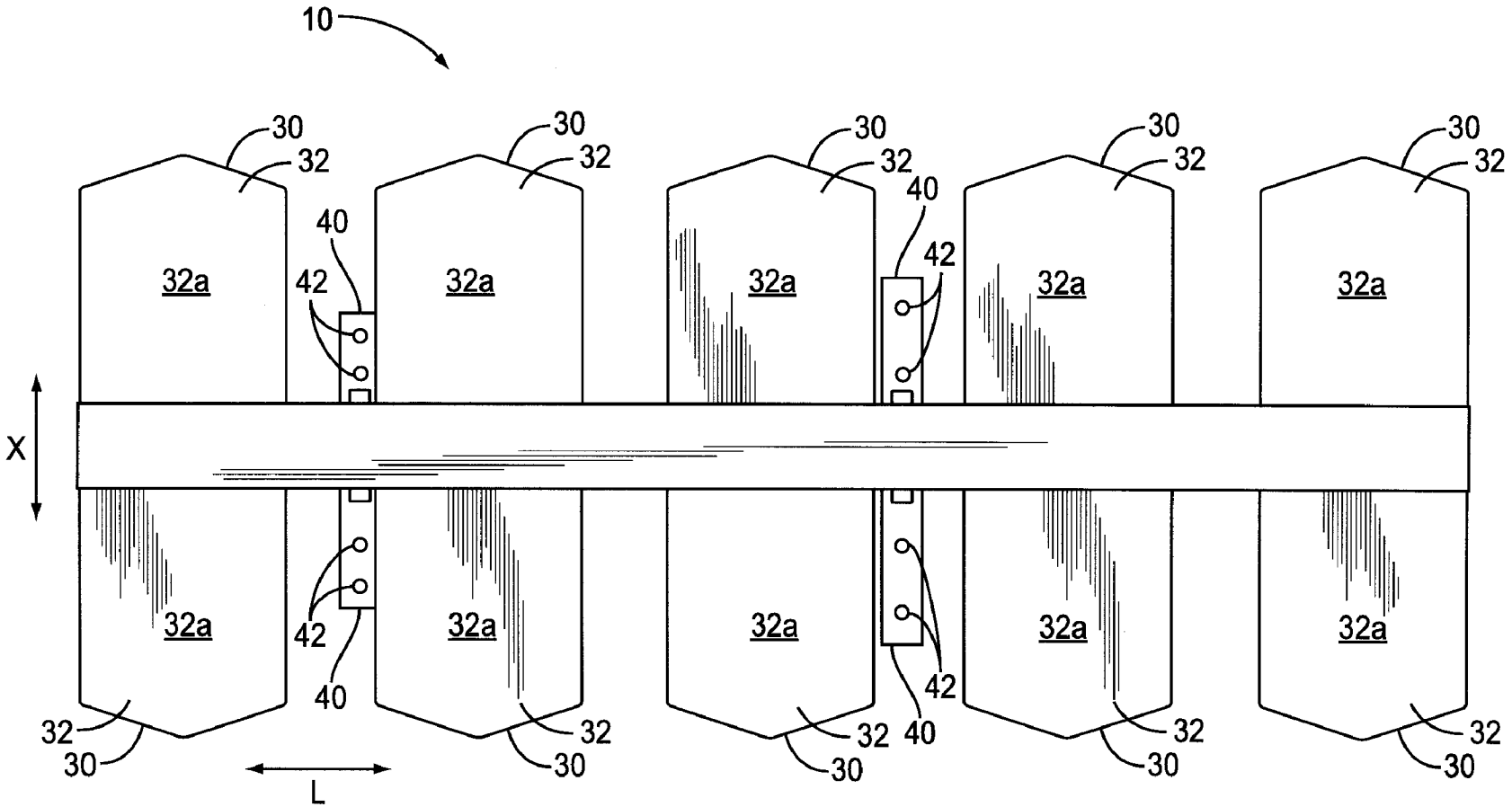
FIG. 3 is a top view of the platen assembly of FIG. 1.

As shown in FIGS. 1, 3 and 5, one embodiment of the platen assembly 10 includes ten garment support members 30, configured such that there are five garment support members 30 positioned on each side of the base member 20. Thus, the upper surfaces 32*a* of the second portions 32 of the garment support members 30 form ten garment supporting surfaces for holding garments during digital printing of the garments. The upper surfaces 32*a* of the portions 32 are preferably positioned at substantially the same height (in direction H) such that garments supported on the garment support members 30 can be presented at substantially uniform vertical spacing from the printing head(s) of a digital printer (not shown).

The longitudinal positions of the garment support members 30 can easily be varied in order to accommodate dimensional requirements and printing head range-of-motion requirements of various digital printers. To adjust the longitudinal position of a garment support member 30, one can first loosen the respective male fastening members 37. Loosening the male fastening members 37 permits the female fastening member 38 to slide relatively freely in the longitudinal direction L within the interior channel portion 26*b*, and also allows the garment support member 30 to be moved in the longitudinal direction L without removing the fastening members 37, 38. Thereafter, one can move the garment support member 30 to the desired position in the longitudinal dimension L, and then tighten the fastening members 37 to secure the garment support member 30 in the desired position. To facilitate precise positioning of the garment support members 30, the top or sides 24 of the base member 20 may be marked off in units of length.

In the configuration shown in FIGS. 1-5, the platen assembly 10 can hold up to ten garments for simultaneous printing on the garments in a printing machine. For example, each garment support member 30 may support a garment, such as a shirt, for printing on a single surface or region of the garment. It should be understood, however, that many different configurations for platen assemblies according to the invention are possible. For instance, a platen assembly may include either a fewer or greater number of garment support members for supporting a desired number of garments. Additionally, garment support members having different shapes and/or sizes than the exemplary garment support members 30 may be employed, thereby allowing printing on garments of different types and/or sizes, or allowing printing on various surfaces or regions of garments. For example, a garment support member may be sized and configured to hold a portion of a shirt or pants such that a shirt pocket, a pant pocket, a shirt back, a shirt front, a shirt sleeve, a pant leg, etc. are presented to one or more printing heads for printing thereon in a single printing operation.

In addition to being adjustable, the garment support members 30 are also easily removable by removing the male fastening members 37 from the female fastening members 38. Therefore, the garment support members 30 may be interchangeable with other, differently shaped and/or differently sized garment support members, as desired.

Figure 6:
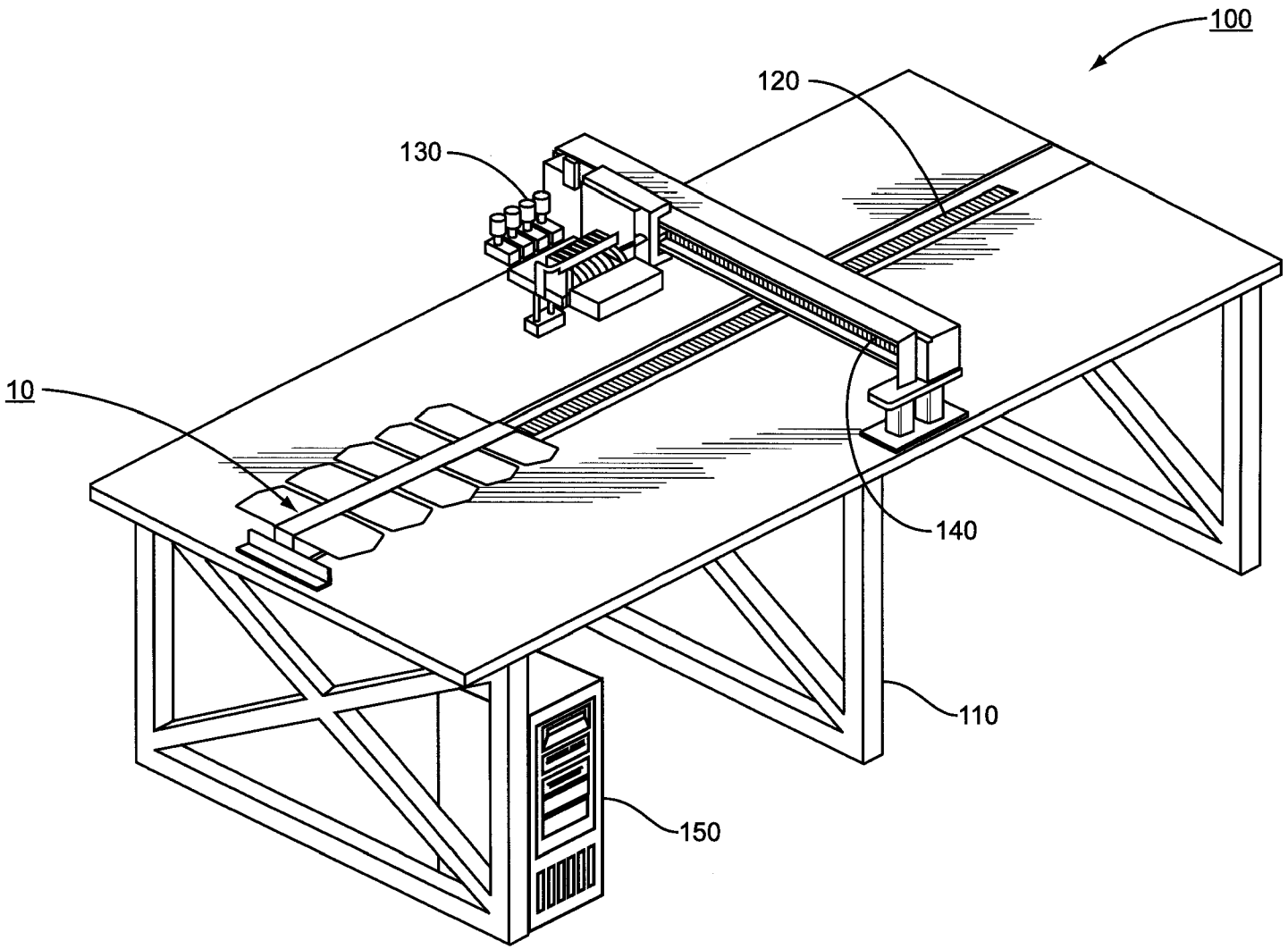
FIG. 6 is a perspective view of a digital printing machine having a platen assembly according to one embodiment of the invention.

FIG. 6 shows a digital printing machine, shown generally as 100, having a platen assembly 10 according to one embodiment of the invention. The digital printing machine comprises a frame 110, a platen assembly 10, as described herein, which is supported by the frame 110 and that moves on a first axis 120, a print head array 130 that is supported by the frame 110 and that moves on a second axis 140, and a computer 150 for controlling the platen assembly 10 and the print head array 130.

In operation, the platen assembly 10 is positioned relative to a print head array, wherein each of a plurality of garment portions is positioned on one of the garment support members 30. Thereafter, either the platen assembly or the print head array, or both, are moved so that each of the plurality of garment portions is printed in a single printing operation. In one exemplary process, the platen assembly 10 is positioned relative to a print head array 130 of a digital printing machine 100, wherein each of a plurality of garment portions is positioned on one of the garment support members 30. Thereafter, the platen assembly 10 is moved on a first axis 120, and the print head array 130 is moved on a second axis 140 so that each of the plurality of garment portions is printed in a single printing operation. As will be appreciated, the process may require that the platen assembly and/or the print head array move several times, or make more than one pass, to complete the printing operation.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that this invention will include all embodiments falling within the scope of the present disclosure.

We claim:

1. A platen assembly for printing on each of a plurality of garment portions in a single printing operation of a digital printing machine, comprising:

(a) a base member configured for operation with a printing machine;

(b) a plurality of garment support members attached to the base member, each support member comprising:

(i) a first portion attached to the base member;

(ii) a second horizontal portion extending outwardly from the base member; and (c) the garment support members being configured to support a plurality of garment portions, permitting printing on each of the plurality of garment portions, without removing, replacing, or repositioning any garment portion.

2. The platen assembly of claim 1, wherein the plurality of garment support members are configured to support a plurality of garment portions of a single garment.

3. The platen assembly of claim 1, wherein the plurality of garment support members are configured to support a plurality of garment portions of a plurality of garments.

4. The platen assembly of claim 1, wherein each of the garment support members is configured to be removably attached to the base member.

5. The platen assembly of claim 1, wherein the base member comprises a rail including a pair of longitudinally extending opposed sides, each side having a longitudinally extending channel.

6. The platen assembly of claim 5, wherein the first portion of each garment support member is fastened to the base member, and wherein a longitudinal position of each garment support member is adjustable within the longitudinally extending channel.

7. The platen assembly of claim 6, wherein each of the garment support members is secured to one of the sides by a fastener, the fastener including:

(i) a female fastening member positioned within one of the longitudinally extending channels; and (ii) a male fastening member inserted through the garment support member and into the female fastening member.

8. The platen assembly of claim 1, wherein each of the garment support members is configured to position a garment portion selected from the group consisting of a garment front, a garment back, a garment sleeve, a garment pocket, and a garment leg.

9. The platen assembly of claim 1, wherein the horizontal portions of the plurality of garment support portions lie in a horizontal plane.

10. The platen assembly of claim 1, wherein the horizontal portions of the plurality of garment support portions are positioned to be the same vertical distance beneath a print head array of a digital printing machine.

11. A digital printing machine for printing on each of a plurality of garment portions in a single printing operation, comprising:

(a) a frame;

(b) a platen assembly that is supported by the frame and that moves on a first axis, the platen assembly comprising:

(i) a base member;

(ii) a plurality of garment support members attached to the base member, each support member comprising:

(A) a first portion attached to the base member;

(B) a second horizontal portion extending outwardly from the base member;

(C) the garment support members being configured to support a plurality of garment portions, permitting printing on each of the plurality of garment portions, without removing, replacing, or repositioning any garment portion;

(c) a print head array that is supported by the frame that moves on a second axis; and (d) a computer for controlling the print table and the print head array.

12. A process for digitally printing on a plurality of garment portions on a digital printing machine in a single printing operation using a platen assembly comprising a base member, and a plurality of garment support members attached to the base member, each support member comprising a first portion attached to the base member and a second horizontal portion extending outwardly from the base member, the garment support members being configured to support a plurality of garment portions, the process comprising:

positioning the platen assembly relative to a print head of a digital printing machine:

positioning each of a plurality of garment portions on one of the garment support members of the platen assembly; and printing on each of the plurality of garment portions, without removing, replacing, or repositioning any garment portion.

* * * * *